US005503727A

United States Patent [19]

Jean et al.

[11] Patent Number: 5,503,727

[45] Date of Patent: Apr. 2, 1996

[54] SOLUBLE ANODE FOR ELECTROPLATING DEVICE

[75] Inventors: Philippe Jean, Florange; Patrice Dufey, Beaumont sur Oise; Hervé Babitch, Metz; Paul Aussure, Neuilly sur Seine, all of France

[73] Assignee: Comptoir Lyon-Alemand-Louyot, Paris, France

[21] Appl. No.: 352,505

[22] Filed: Dec. 9, 1994

[30] Foreign Application Priority Data

Dec. 28, 1993 [FR] France ..... 93 15951

[51] Int. Cl.[6] ..... C25C 7/02

[52] U.S. Cl. ..... 204/286

[58] Field of Search ..... 204/280, 198, 204/202, 206, 286, 197, 196; C25C 7/02

[56] References Cited

U.S. PATENT DOCUMENTS 2,116,929 5/1938 Harshaw ..... 204/4

2,462,968 3/1949 Hogaboom et al. ..... 204/284

3,151,048 9/1964 Conley et al. ..... 204/13

*Primary Examiner*—Kathryn Gorgos

*Attorney, Agent, or Firm*—Sixbey, Friedman, Leedom & Ferguson

[57] ABSTRACT

A soluble anode is provided for electroplating coating metal, such as nickel, onto a moving metal sheet. The anode includes an anode body (40) consisting of coating metal, which extends along a longitudinal direction, and an anode head (41) provided with a hook (33) for fastening and for electrical connection to a support for supplying electrical current. The anode head is formed from a metal baseplate (62) connected by welding beads (63,64) of the anode body, to ensure temporary mechanical connection of the head to the anode body, and to connect them electrically, while allowing the anode head (41) to be reused, after removal of the welds, after the anode body (40) is consumed.

7 Claims, 2 Drawing Sheets

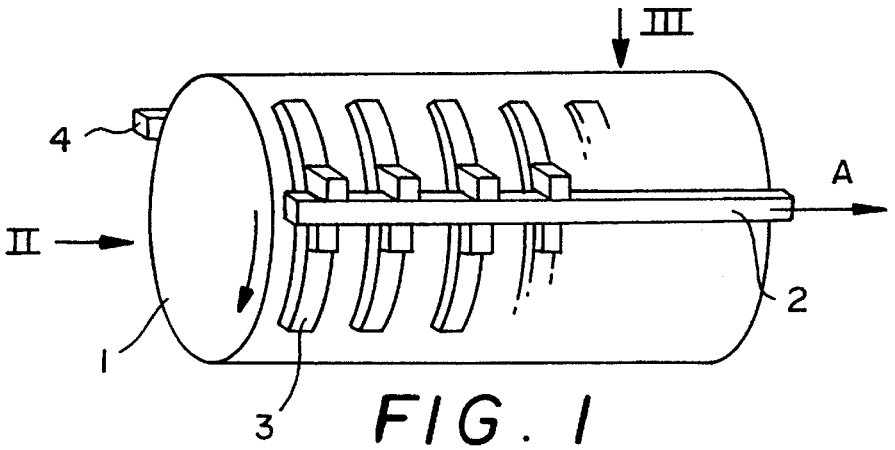
FIG. 1
(PRIOR ART)
FIG. 2
(PRIOR ART)
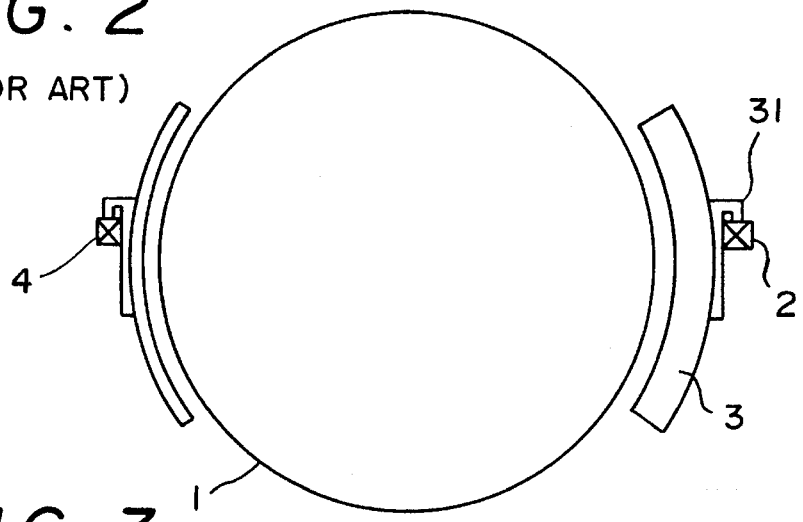
FIG. 3
(PRIOR ART)
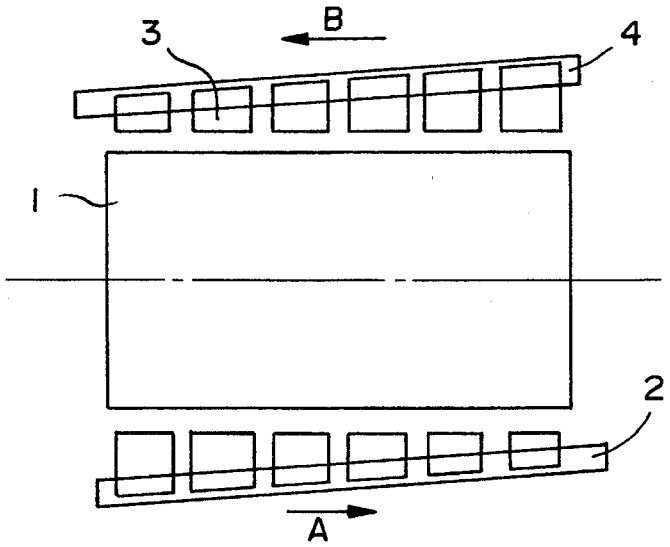

SOLUBLE ANODE FOR ELECTROPLATING DEVICE

FIELD OF THE INVENTION

The present invention relates to an electroplating device having a soluble anode, used especially for depositing nickel or zinc-nickel on steel and, more particularly, the production of such a soluble anode.

PRIOR ART

It is known that, with a constant desire to reinforce the corrosion stability of some exposed parts of motor vehicles, such as the bodywork, the automotive industry employs soft sheet steel coated with a thin protective layer made of zinc or of zinc-based alloy, such as, for example, zinc-nickel.

In particular in order to improve bonding of the zinc layer on the steel, the technique of multiply coated sheet metal has been developed, which consists in depositing one or more intermediate layers, for example of nickel, between the steel and the outer zinc layer.

Industrially, the technique consists in inserting, in a zinc plating line, a series of electrolysis vats through which the sheet metal to be coated passes, this sheet metal passing over various return rolls which are themselves immersed in vats filled with electrolyte. Following the classical electrolysis parameters, such as the anodic current density, the composition of the electrolyte and the speed of advance makes it possible to guarantee the desired result.

In regards to the deposition of nickel, the conventional deposition method uses a nickel salt, such as nickel chloride, in solution, which leads to correct results but presents a number of problems when used.

For example, storage of nickel salts quickly leads to creation of a workshop handling problem with the losses which are associated therewith. Another, more serious drawback is that nickel dust salts are discharged into the atmosphere and may constitute a risk for exposed personnel.

In addition, these electrolysis baths become gradually more concentrated in undesirable elements.

In order to avoid these problems, steel producers have turned to techniques using bulk nickel anodes, from which the nickel is deposited. In this technique, the sheet metal to be treated is the cathode and a liquid electrolyte occupies the interelectrode gap. As the metal is deposited on the sheet metal to be treated, which moves in front of the anodes, the thickness of these anodes decreases and the interelectrode gap (distance between the surface of the nickel anode and the surface of the treated sheet metal, or cathode), therefore, commensurately increases.

The anodes used in this technique are generally bulk anodes obtained by rolling ingots which are cast semicontinuously, then slit and bent. The thickness of a new anode is, for example, approximately 60 mm, but this thickness decreases as it is used, so that the gap between anode and sheet metal tends to increase, and all other things being equal, the quantities of nickel deposited per unit time decrease. This may result in nonuniformity of the quantity of nickel deposited per unit area along the sheet metal to be treated.

Means are, however, provided as a general rule in the construction and operation of the installations in order to overcome this drawback.

(BRIEF) DESCRIPTION OF THE DRAWINGS

For a clearer understanding of the method, reference should be made to the diagram in FIG. 1, which represents the normal known arrangement of the anodes in the vicinity of a cylindrical roll over which the sheet metal to be treated, constituting the cathode, passes. This cylindrical roll 1 is made of insulating material, apart from a central part which is electrically conducting. This part is in contact with the sheet metal to be treated, which completely masks it and returns the electrical current to the generator.

A graphite support bar 2 is placed laterally to the cylinder 1, the former accommodating up to twelve anodes 3 of inwardly curved shape, having, for example, a length of 1520 mm and a width of 160 mm. The diagram in FIG. 2 shows that a second set of anodes is arranged identically on a support 4 which is substantially diametrically opposite. In order to make it possible to ensure deposition which is as uniform as possible, the anodes are translated along the bar 1 in the axial direction A; the new anodes being introduced from one side of the installation while the spent anodes are extracted from the other side. The diagram in FIG. 3 will better explain the movement of the anodes; these movements being organized in opposite directions on the support bars 2 and 4, on either side of the cylindrical roll supporting the sheet metal to be treated. This choice for the movement of the anodes has the result that two opposite anodes are always such that the sum of their thicknesses is constant, as is the sum of their gaps from the cathode. This results in a more uniform deposition of nickel in the width and length directions of the sheet metal.

The apparent resistivity of an electrolyte is of the order of $10^{-2}$ to $10^{-1}\Omega$.m, i.e. at least $10^5$ times higher than that of a metallic conductor such as nickel; the resistivity of which is $7.10^{-8}$ $\Omega$.m. This has two important consequences: the first is that the distribution of current density on the surface of an anode depends on the distance from the cathode facing each point of the anode. Since bulk nickel conducts much better than the electrolyte bath, its surface is always an equipotential, whatever its shape and its design. The second consequence is that the resistance of the circuit is essentially due to the electrolyte bath itself. This is reduced by reducing the interelectrode gap; that is to say the distance between the surface of the anode and that of the sheet metal to be treated, as far as possible, which makes it possible to improve the energy balance. However, for each anode taken individually, as it is translated along the support bar, the interelectrode gap increases and the current density to which this anode is subjected decreases as it is consumed.

The result of this is that, at a given instant, the current density is not identical for all the anodes. It is not desirable to increase the interelectrode gap since this locally increases the electrical resistance exhibited by the electrolyte, whence power losses and undesirable heating of the electrolyte. These considerations are of great importance because the current density is high, of the order of 100 A/dm$^2$ of anode surface, or even more.

In order to eliminate these effects, the graphite bars used as a support and current input for the anodes are at a slant with respect to the axis of the cylinder; that is to say, that their axis is placed obliquely with respect to the axis of the roll supporting the sheet metal. The diagram in FIG. 3 shows the opposite movements of the anodes on each of the support bars 2 and 4 and how obliquely arranging these bars with respect to the axis of the cylindrical roll 1 makes it possible to keep the interelectrode Rap or distance separating the anodes from the roll 1 constant. Thus, as the anodes are consumed, the interelectrode gap remains constant at any instant and at any point, whatever the anode in question and wherever it is.

The design of an anode according to the known method constituting the prior art of the invention is represented in FIG. 4. The anodes are fastened onto the graphite bar using a hook 33 of a bulk anode head 31; this anode head being welded permanently to the anode body 30 by a continuous weld bead 32, at least on the edges of the anode head.

Such an embodiment makes it possible to ensure that the anode head is perfectly rigid, that there is optimum contact between the current input bar, and especially that there is perfect contact between the head and the anode body.

In view of the geometry which is necessary, the anode head cannot be cast directly, but is obtained mechanically and by welding starting with precut nickel sheets.

Analysis shows, therefore, that the cost of producing this anode head is predominant in the total production cost of the anode. In addition, when the anode body is spent, the entire anode is recycled and recast, including the anode head which is not spent but which is attached to the spent part.

SUMMARY OF THE INVENTION

The object of the present invention is to reduce the manufacturing costs of the anode while retaining the qualities of rigidity of the anode body and of good electrical contact on the one hand with the anode body, and to allow this anode to be used in existing installations, therefore, without modifying the system for fastening the anode head onto the current supply bar.

With these objectives in mind, the subject of the invention is a soluble anode used for electroplating coating metals onto moving sheet metal, comprising an anode body consisting of the said coating metal, which extends along a longitudinal direction, an anode head and means for temporary attachment of the anode head to the anode body; these means ensuring electrical contact between the body and the anode head, wherein the temporary attachment means include an intermediate metal plate, fixed permanently on the anode head and extending parallel to the anode body and being connected to the said body by welding.

The head and the anode body can thus be separated when the anode body is spent, without damaging the anode head. The anode body can then be remelted and recycled on its own, and the anode head can be reused by subsequent reattachment onto a new anode body.

This type of design has an undeniable economic advantage since the most complex part, which is the fastening system of the anode, can, according to the invention, be reused on other anodes instead of being recycled by remelting everything. This is even more advantageous since, according to the comments which have been made, the current fastening system or anode head emerges practically intact from the electrolytic bath.

By virtue of the invention, interposition between the body and the anode head of an assembly baseplate, mounted on the anode head when it is made and subsequently used as a part for mechanical and electrical connection to the consumable anode body by welding and advantageously carried out on the edges of the baseplate, allows easy detachment of the head and the anode body, for example by grinding the weld beads.

This arrangement makes it possible to recover the anode head after removal of the weld beads insofar as, by virtue of the large dimensions of the plate compared to the anode head, it is possible to remove the weld beads without risk of damaging the anode head.

According to a particular arrangement, the plate extends along the longitudinal direction of the anode body, and the weld beads are made only at the ends of the plate. This arrangement has the advantage of simplifying as much as possible the operations of assembling the anode head on a new anode head since it is sufficient to make two, preferably straight, weld beads transversely to the longitudinal direction of the anode body in order to ensure reliable mechanical connection and optimum electrical contact, without risk to leading to secondary parasitic phenomena such as voltage drops.

It should be pointed out that the current intensity flowing in an anode is generally very high, of the order of 1000 to 2500 A. This high current must pass from the head to the body of the anode without encountering obstacles. It is, therefore, desirable to reduce as much as possible the electrical resistance of the means for attaching the head onto the body this resistance being preferably less than approximately 0.1 m Ω, so as not substantially to add a resistance to the contact resistance existing between the anode head and the bar for supplying current and supporting the anodes, which is of the order of 2.5 to 4.5 m Ω, depending on the degree of wear of the anode.

The electrical resistance between the head and the anode body should preferably have a value at least 25 times less than that of the contact resistance between the anode head and the bar.

In the case of the variant indicated above, the resistance between the head and the anode body can easily be less than the value of 0.1 m Ω indicated previously; this resistance depending on the cross section of the weld beads, considered transversely to the direction of flow of the current, that is to say along the longitudinal direction of the weld beads. It will clearly be understood that this resistance may have a very small value and, if desired, can easily be reduced by simply increasing the size of the weld beads.

In addition, the particular arrangement mentioned previously also has the advantage that the anode body can be detached easily from the anode head. It is actually sufficient to cut the plate transversely to the longitudinal direction of the anode body, between the weld bead and the anode head, in order to detach the latter from the anode body. Cutting can be carried out easily, for example by sawing or grinding, and without risk of damaging the anode head, by virtue of the fact that the plate extends far from the head, and the cutting zone is therefore easily accessible.

Cutting is preferably carried out as close as possible to the weld bead, which makes it possible to retain a maximum length of the plate after cutting. The anode head and the associated plate can thus be reused a large number of times, each time making a new weld of the ends of the plate onto a new anode body, after having made the cuts on the spent anode. Although the length of the plate is reduced each time it is cut, this reduction may be sufficiently small, by making the cut as close as possible to the weld bead, to allow numerous reuses before the weld beads become too close to the anode head.

The weld beads are preferably made of the same material as the anode.

Other characteristics and advantages of the invention will emerge from the following description of several embodiments of an anode according to the invention.

DESCRIPTION OF THE PREFERRED EMBODIMENTS

BRIEF DESCRIPTION OF THE DRAWINGS

Reference will be made to the attached drawings, in which:

FIG. 1 is a diagrammatic view of the essential parts of a known installation of the prior art for electrolytic deposition using soluble anodes, for example made of nickel, which can be moved on a bar for support and supply of electrical current, the cathode consisting of the sheet steel intended to receive the electrolytic deposition of the metal of the anode and being supported by a cylindrical roll made of insulating material except for a central, electrically conducting part;

FIG. 2 is a front view of the installation, along the arrow II in FIG. 1;

FIG. 3 is a plan view of the installation along the arrow III in FIG. 1;

Figure 4:
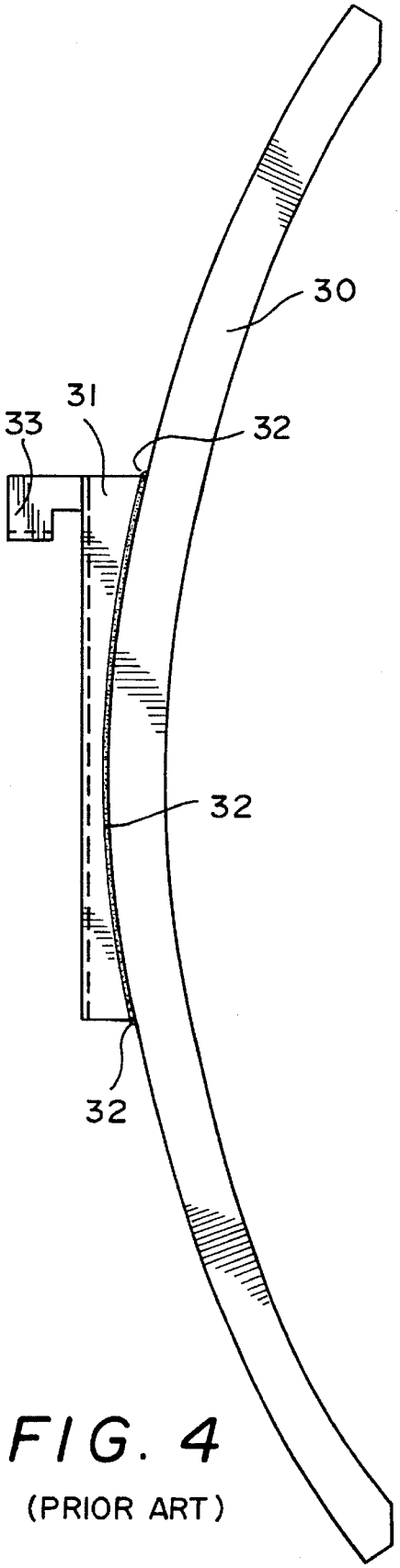
FIG. 4 (PRIOR ART)
FIG. 4 is a side view of the device forming an anode according to the prior art, showing the anode head permanently attached to the anode body.

The electroplating installation represented in FIGS. 1, 2, 3 and 4 has already been described in the introduction of this document, which details the characteristics of an installation according to the prior art, to which part reference may be made. The anode according to the prior art, represented in FIG. 4, includes an inwardly curved anode body 30 which extends longitudinally in a plane perpendicular to the axis of rotation of the roll 1, and an anode head 31 provided with a hook 33 for connection to the bars 2, 4 for support and supplying current. The anode head is welded over its entire periphery to the anode body by weld beads 32.

A description will now be given, with reference to FIG. 5, of an embodiment of an anode according to the invention.

As is seen, the means for connecting the head 61 to the anode body 40 include an intermediate plate 62, permanently attached to the anode head 61 and extending at a distance from the latter, parallel to the anode body. The plate 62, therefore, has a curvature corresponding to that of the anode body, to which it is connected by weld beads 63, 64 made at its ends. Since the dimension of the plate, in the longitudinal direction of the anode body, is considerably larger than the height of the anode head, weld beads are located sufficiently far from the anode head 61 for it to be possible, when the anode body is spent, to remove the weld beads 64 and thus detach the anode body from the anode head without damaging the latter.

Figure 5:
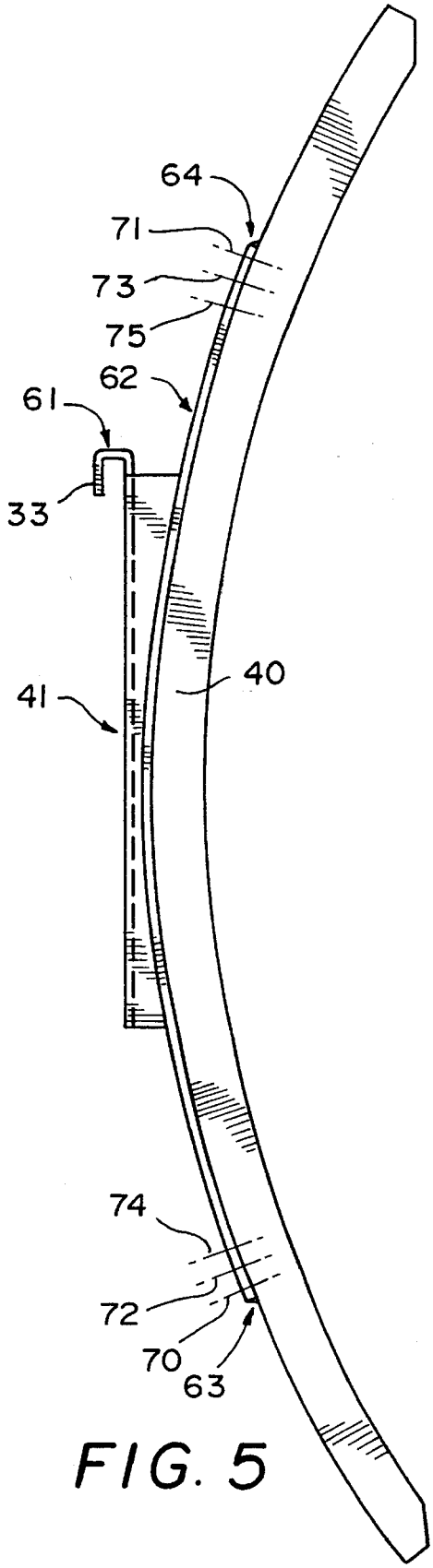
FIG. 5 represents an anode according to the present invention, with a weld bead between an intermediate plate attached to the anode head, and the anode body, allowing subsequent cutting of the intermediate plate, a plurality of times, when the anode body is spent.

The weld beads are preferably made only at the top and bottom ends, according to the view in FIG. 5, of the plate 62, and along a direction perpendicular to the longitudinal direction of the electrode body.

Thus, when the anode body is spent, it is sufficient, in order to detach the body from the anode head, to cut the ends of the plate, for example by sawing or grinding, parallel and as close as possible to the weld beads 64.

The cut ends remain attached to the anode body with the weld beads 64, but the anode head 61, along with the remaining part of the plate 62, are detached from the anode body and can be reused with a new anode body, after having made new weld beads at the ends of the plate 62.

Insofar as the plate can be cut in immediate proximity to the weld beads and the ends of the plate 62 are, on a new anode head, remote from the latter, it is possible successively to make numerous cuts 70, 71, 72, 73, 74, 75 and welds, and thus to reuse the anode head as many times.

For example, in the case of a nickel anode, the plate 62 is also made of nickel and has a thickness of approximately 10 mm. The dimensions of the weld beads, in cross section and in length, are sufficient to ensure that the current flows correctly.

In this example, a weld bead made over a length of 160 mm constitutes a resistance with a length of approximately 10 mm in the direction of flow of the current, the cross section of which is 10 mm by 160 mm, made of nickel, the resistivity of which is $7.10^{-8}$ Ω.m: the resistance presented by such a weld bead is 0.4 μΩ. This resistance is ten times less than that of the bolted assembly of the preceding example and presents no electrical disturbance to the system.

Since the support plate 62 of the anode head is very slightly shortened on each operation, each reuse is accompanied by alteration of the exact position of the current supply points on the anode. This does not, however, alter the distribution of the current densities on the surface of the anode because, since the resistivity of the electrolysis bath is at least 1000 times higher than that of the bulk metal constituting the anode, the entire anode is equipotential.

It is clear that the invention is not limited to the example which has been described, but extends to multiple variants or equivalents insofar as the definition of the invention, given by the attached claims, is respected.

We claim:

1. A soluble anode used for electroplating a coating metal onto moving sheet metal, comprising an anode body consisting of the coating metal, which extends along a longitudinal direction, an anode head and means for temporary attachment of the anode head to the anode body to render the anode head reusable with another anode body, the temporary, attachment means ensuring electrical contact between the body and the anode head, wherein the temporary attachment means includes an intermediate metal plate, fixed permanently on the anode head and extending parallel to the anode body and having end and edges spaced apart from the anode head that are connected to body by weld connection, said edges of the plate being spaced apart from the anode body to facilitate detachment of said weld connection between the plate and the anode body.

2. The anode as claimed in claim 1, wherein the plate extends along the longitudinal direction of the anode body, and in that the weld connection is made only on its edges.

3. The anode as claimed in claim 2, wherein the weld connection of the edges of the plate is limited to the ends of said plate alone.

4. The anode as claimed in claim 1, wherein the weld connection consists of weld beads.

5. The anode as claimed in claim 4, wherein the weld beads are straight transversely to the longitudinal direction of the anode body.

6. The anode as claimed in claim 1, wherein the attachment means are made of the same material as the anode body.

7. In an improved soluble anode used for electroplating a coating metal onto moving sheet metal having an anode body consisting of the coating metal, and an anode head permanently and directly attached to said anode body, wherein the improvement comprises means for temporary attachment of said anode head to said anode body to render said anode head reusable with another anode body, said temporary attachment means including an intermediate metal plate permanently connected to said anode head and having edges spaced apart from said head, and weld connection between said plate edges and said anode body for the temporary electrical and mechanical connection of said head to said body, wherein the spacing of said edges from said head facilitates the removal of said weld connection between said plate and said anode body.

* * * * *